US005725113A

United States Patent [19]

Habisohn

[11] Patent Number: 5,725,113

[45] Date of Patent: Mar. 10, 1998

[54] METHOD FOR DEACTIVATING SWING CONTROL ON A CRANE

[76] Inventor: Chris X. Habisohn, 1505 Falcon La., Hoffman Estates, Ill. 60192

[21] Appl. No.: 739,023

[22] Filed: Oct. 28, 1996

[51] Int. Cl.[6] ..... B66C 19/00

[52] U.S. Cl. ..... 212/275; 212/284; 340/685

[58] Field of Search ..... 340/685; 212/274, 212/275, 276, 284, 286, 329

[56] References Cited

U.S. PATENT DOCUMENTS 5,490,601 2/1996 Heissat et al. ..... 212/275
5,526,946 6/1996 Overton ..... 212/275

*Primary Examiner*—Thomas J. Brahan
*Attorney, Agent, or Firm*—Jerome Goldberg

[57] ABSTRACT

A method of deactivating an electronic load oscillation dampener on a crane when the crane is reverse plugged is present. Thus allowing the crane to stop faster in emergency situations.

4 Claims, 1 Drawing Sheet

METHOD FOR DEACTIVATING SWING CONTROL ON A CRANE

FIELD OF THE INVENTION

The present invention relates generally to a method for deactivating a dampening controller that dampens the load swing of the load of a crane.

STATE OF THE ART

Suspension cranes are used to support and transport loads suspended by a variable length rope hoist. The hoist is attached to a carriage which is traversed along a track. It is desirable to reduce oscillation of the load when it is moved by the crane. Variable speed motor drives on cranes allow very fine and smooth control of the carriage and the load on their traversing run. A traversing run is the travel of the carriage from a beginning rest position to an end rest position. Present methods of damping load oscillations have focused on generating a drive signal that, when input into the motor drives controlling the crane carriage's horizontal motion, will produce minimal swing. A load oscillation dampener is that part of the control system that shapes the drive signal in a manner that minimizes the swing of the load. Certain known damping methods use a closed loop with feedback control from the angular deviation of the hoisting rope from rest. In these closed loop methods, the signal corresponding to the magnitude of the deviation of the rope suspending the load from vertical is fed back into a load oscillation dampener. The dampener adjusts the speed signal sent to the motor controlling the horizontal motion of the crane in a manner that will dampen the load. U.S. Pat. No. 5,219,420 by Kiiski and Mailisto, 1993, proposes such a method.

Other known damping methods include open loop controls which do not use angular deviation feedback from the rope. However, open loop methods are limited to insuring that the load will not be oscillating or have minimal swing after a transition from one constant speed to another, assuming the load was initially not swinging. This presumes that no other forces, except gravity and the carriage motor force are acting on the load. In particular, if the load is not swinging at the beginning of a carriage run then it will not be swinging at the end of the run.

In a common open loop technique, the acceleration rate is fixed. A request for a change in speed results in computing an acceleration time that will provide for half the requested speed change at the fixed acceleration rate. The fixed acceleration rate is applied to the motor for the determined acceleration time and then followed by an equal interval of acceleration one-half period later. Accelerations applied in this manner dampen load swing.

A common feature to all electronic load oscillation damping systems is that changes in speed commands cannot be instantly compensated. A certain settling time must elapse before speed changes are entirely compensated. The load oscillation dampener must spread out the carriage accelerations over time to dampen load oscillations. This is a disadvantage in emergency situations where the operator needs the carriage to stop fast. In such situations, if the load oscillation dampener is active, the spread out carriage accelerations cause the crane to travel farther prior to stopping than if the load oscillation dampener was deactivated. With the load oscillation dampener deactivated, the emergency deceleration may occur at a maximum uninterrupted rate to stop the carriage as soon as possible. During emergency situations, some crane operators prefer to deactivate the load oscillation dampener with an on-off switch.

Generally, an operator initiates carriage motion by pressing the forward or reverse button on the crane's pendant station. During non-emergency use, the operator removes his finger from the button to decelerate the crane to a stop. For a typical crane without a load oscillation dampener, operators use a procedure called reverse plugging to deal with emergency situations. Reverse plugging means that the operator removes his finger from the direction button he was pressing and then presses the direction button of the opposite direction while the carriage is still traveling. Many variable frequency drives programmed for crane use employ a higher deceleration rate to stop the crane faster when the pendant station is reversed plugged.

OBJECT OF THE INVENTION

A primary object of the invention is to provide a method of deactivating a crane load oscillation dampener in emergency situations in response to a reverse plugging action.

SUMMARY OF THE INVENTION

The invention presented in this patent is a method for deactivating a load oscillation dampener on a crane. The carriage of the crane is driven by a motor means responsive to a drive signal. The drive signal is produced by a motion controller in response to operator motion commands including direction signals. The motion controller includes a load oscillation dampener.

In the inventive method, the operator applies a first direction signal to the motion controller to initiate carriage motion in the direction associated with the first direction signal and to activate the load oscillation dampener to produce motion that damps load oscillation. While the carriage is still traveling, the first direction signal is removed from the motion controller and a second direction signal corresponding to a direction opposite to that of the first direction signal is applied, thus a reverse plugging action is performed. The reverse plugging action is detected and, upon detection of the reverse plugging action, the load oscillation dampener is deactivated. With the load oscillation dampener deactivated, the carriage accelerations will not be spread out and the carriage will stop sooner. A greater deceleration rate may be used by the motion controller during the reverse plugging action than when the load oscillation dampener was activated.

BRIEF DESCRIPTION OF THE DRAWINGS

The present invention may be better understood with reference to the detailed description in conjunction with the following figures where the same reference numbers are employed to indicate corresponding identical elements.

DESCRIPTION OF THE PREFERRED EMBODIMENT

Figure 1:
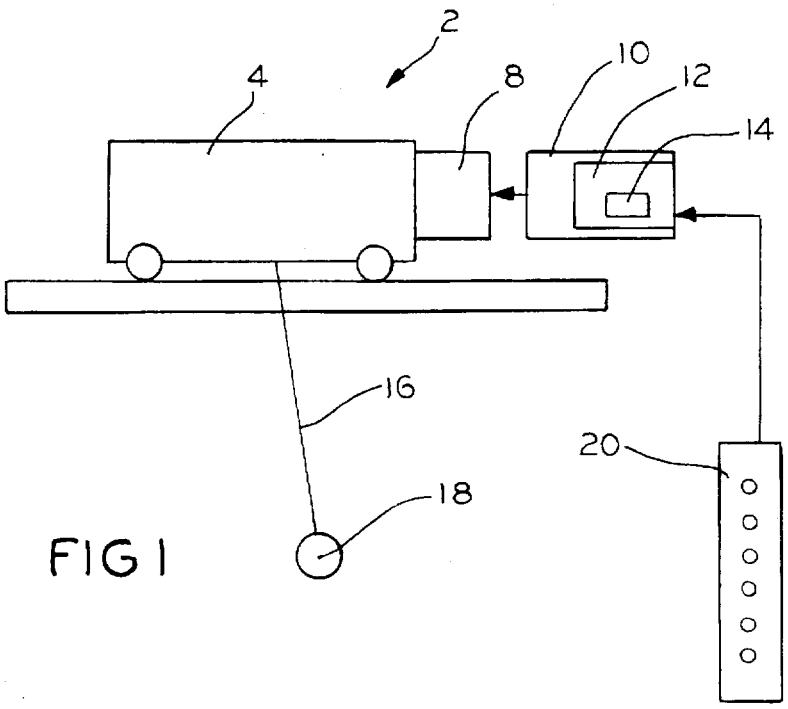
FIG. 1 is a block diagram of a crane system which includes a crane bridge or trolley carriage driven horizontally from one location to another along a track.

FIG. 1 is a block diagram of a crane system 2 which includes a crane bridge or trolley carriage 4 driven horizontally from one location to another along a track 6. The traversing movement of the carriage 4 is powered by a motor 8 which is controlled by a motor drive 10. The motor drive 10 receives a drive signal from a motion controller 12. In this preferred embodiment, the motor 8 is a three phase squirrel cage induction motor, the motor drive 10 may be a variable frequency drive, and the motion controller 12 is embedded into the electronic logic of the drive 10. The motion controller contains a load oscillation dampener 14. The load oscillation dampener 14 shapes the drive signal to move the carriage 4 and simultaneously prevents swinging of a hoisting rope 16 and a load 18 connected to the hoisting rope 16. A motion selector 20 is used by the crane operator to control the desired motion of the carriage 4 along the track 6. Generally, an operator inputs a desired motion such as a direction (forward or reverse) and a desired speed to the motion selector 20 through a push button arrangement. However more complex variable speed selection arrangements may be used.

Figure 2A:
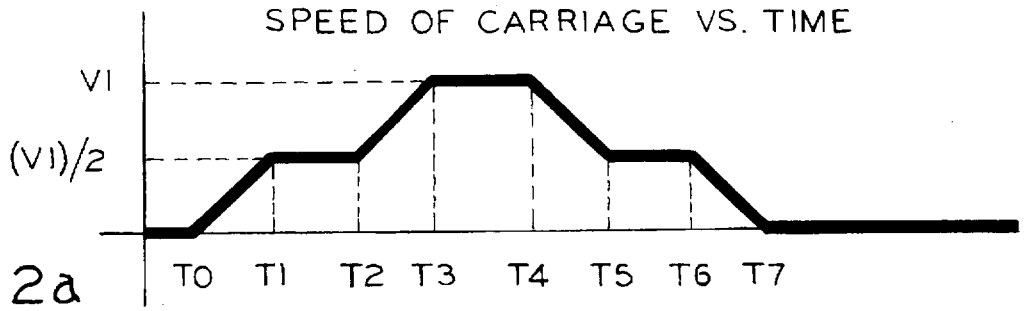
FIG. 2*a* is a graph of the speed of the carriage speed vs. time which would result if the operator issued an initial motion command for the carriage to attain a speed of V1 in a certain direction, and then removed the motion command to allow the carriage to come to a stop under the control of the load oscillation dampener.

FIG. 2*a* is a graph of the speed of the carriage 4 speed vs. time which would result if the operator issued an initial motion command for the carriage 4 to attain a speed of V1 in a certain direction, and then removed the motion command to allow the carriage 4 to come to a stop under the control of the load oscillation dampener 14. The operator issues the initial motion command by pressing either the forward or reverse direction button on the pendant of the crane. In this embodiment it is assumed that the load oscillation dampener 14 operates on the open loop principle that load oscillation can be damped by applying an acceleration interval followed by an equal acceleration one-half period later. This is demonstrated in the FIG. 2*a* by the carriage 4 initially accelerating at time t0 to the velocity (V1)/2 at time t1, followed by an equal acceleration beginning at time t2 and ending at time t3 to attain the desired speed V1. The time between t0 and t2 is one-half of the period of oscillation of the load, presumably the load oscillation period was either programmed into the load oscillation dampener 14 or it was dynamically determined using a rope length sensor. The period of oscillation is derived from the measured rope length using the physical relation that oscillation period is proportional to the square root of the rope length. At time t4, the motion command is removed by the operator lifting his finger from the direction button, and the carriage 4 begins decelerating to (V1)/2 which is obtained at time t5. At time t6, a second equal deceleration interval is performed to bring the carriage 4 to a stop at time t7. The extra time between t5 and t6 would cause this deceleration profile to be too long to be used in an emergency situation.

Figure 2B:
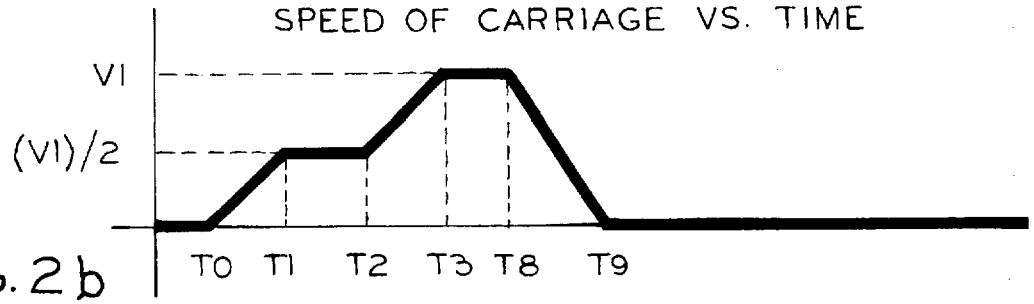
FIG. 2*b* is a graph of the speed of the carriage speed vs. time which would result if the operator issued an initial motion command for the carriage to attain a speed of V1 in a certain direction and then performed a reverse plug operation.

FIG. 2*b* is a graph of the speed of the carriage 4 speed vs. time which would result if the operator issued an initial motion command for the carriage 4 to attain a speed of V1 in a certain direction and then performed a reverse plug operation. The graph is the same as FIG. 2*a* up to time t8, when the reverse plugging action occurs and the load oscillation dampener 14 is deactivated. The carriage 4 begins decelerating to a stop which is achieved at time t9. Because the load oscillation dampener is deactivated, the load may be swinging at time t9. Note that the deceleration rate between times t8 and t9 is constant and uninterrupted and does not necessarily have to be equal to the deceleration rate used in FIG. 2*a*. Indeed, the motion controller 12 may have a fast-stop feature where an alternate faster deceleration rate is employed during reverse plugging after the load oscillation dampener 14 is deactivated. The deceleration rate employed during reverse plugging may be set at the maximum rate possible to assure a quick stopping action.

One method for the motion controller 12 to detect the reverse plugging action of the operator is to record the initial direction the operator chose at the beginning of each carriage 4 run. A reverse plugging action would then be detected if the motion controller 12 received a direction signal opposite to the recorded initial direction during the run of the carriage 4.

Some load oscillation dampeners have the property that the direction of carriage 4 travel will not reverse during a carriage 4 run unless a reverse plugging action is performed. The load oscillation dampener based on the applying of equal accelerations one-half period apart, as depicted in FIG. 2*a* and FIG. 2*b*, is of this type. For this type of load oscillation dampener, a second method for detecting a reverse plugging action would be for the motion controller 12 to continuously compare the direction of carriage 4 travel with the direction command received from the operator. If the two directions are opposite, then a reverse plugging action is detected.

The above described embodiment is merely illustrative of the principles of this invention. Other arrangements and advantages may be devised by those skilled in the art without departing from the spirit and scope of the invention. Accordingly, the invention should be deemed not to be limited to the above detailed description but only by the spirit and scope of the claims which follow.

I claim:

1. A method for deactivating a load oscillation dampener on a crane, said load being suspended by a hoisting rope attached to the carriage of the crane, said carriage being driven by a motor means responsive to a drive signal, said drive signal being produced by a motion controller in response to operator motion commands including direction signals, said motion controller including said load oscillation dampener, said method including the steps of:

(a) applying a first direction signal, corresponding to a first direction, to the motion controller for initiating carriage motion in said first direction and activating said load oscillation dampener to produce carriage motion that damps load oscillation;

(b) removing said first direction signal from said motion controller and applying a second direction signal corresponding to a direction opposite to that of said first direction while said carriage is still traveling, to perform a reverse plugging action;

(c) detecting said reverse plugging action; and, (d) deactivating said load oscillation dampener upon detection of said reverse plugging action.

2. A method according to claim 1 wherein a greater deceleration rate is used by the motion controller during said reverse plugging action than when said load oscillation dampener was activated.

3. A method according to claim 1 wherein step (c) includes:

(c1) recording said first direction signal;

(c2) comparing subsequent direction signals said first direction signal;

and wherein a reverse plugging action is detected if the direction corresponding to said subsequent direction signal is opposite to said first direction.

4. A method according to claim 1 wherein step (c) includes:

(c1) comparing subsequent direction signals with the direction of carriage travel;

and wherein a reverse plugging action is detected if the direction corresponding to said subsequent direction signal is opposite to said direction of carriage travel.

* * * * *